US008142047B2

(12) United States Patent
Acampora et al.

(10) Patent No.: US 8,142,047 B2
(45) Date of Patent: Mar. 27, 2012

(54) ARCHITECTURAL LIGHTING

(75) Inventors: Ken J. Acampora, Northridge, CA (US); Kristen Quevy, Canoga Park, CA (US)

(73) Assignee: ABL IP Holding LLC, Conyers, GA (US)

( * ) Notice: Subject to any disclaimer, the term of this patent is extended or adjusted under 35 U.S.C. 154(b) by 353 days.

(21) Appl. No.: 12/637,377

(22) Filed: Dec. 14, 2009

(65) Prior Publication Data

US 2011/0141722 A1 Jun. 16, 2011

(51) Int. Cl.
*F21V 21/00* (2006.01)

(52) U.S. Cl. ..... 362/217.01; 362/217.02; 362/217.12; 362/217.14

(58) Field of Classification Search ..... 362/217.01, 362/219, 222, 223, 225, 217.02, 217.04, 362/217.08, 217.09, 217.1, 217.11, 217.12, 362/217.13, 217.14, 217.15, 217.16, 217.17
See application file for complete search history.

(56) References Cited

U.S. PATENT DOCUMENTS

| | | | | | |
|---|---|---|---|---|---|
| 2,474,308 | A * | 6/1949 | Franck et al. | ..... | 362/224 |
| 3,535,509 | A * | 10/1970 | Thornton | ..... | 362/220 |
| 4,463,413 | A * | 7/1984 | Shirley | ..... | 362/401 |
| 4,803,606 | A * | 2/1989 | Rotter | ..... | 362/249.09 |
| 4,862,336 | A * | 8/1989 | Richardson et al. | ..... | 362/285 |
| 5,424,931 | A * | 6/1995 | Wheeler | ..... | 362/418 |
| 5,702,177 | A * | 12/1997 | Lin | ..... | 362/648 |
| 5,716,126 | A * | 2/1998 | Meyer | ..... | 362/287 |
| 5,791,764 | A * | 8/1998 | Jaksich | ..... | 362/222 |
| 6,019,484 | A * | 2/2000 | Seyler | ..... | 362/287 |
| 6,139,164 | A * | 10/2000 | Bolta et al. | ..... | 362/217.1 |
| 6,530,674 | B2 * | 3/2003 | Grierson et al. | ..... | 362/219 |
| 6,644,829 | B1 * | 11/2003 | Tracy et al. | ..... | 362/220 |
| 6,854,862 | B1 * | 2/2005 | Hopf | ..... | 362/220 |
| 6,869,209 | B2 * | 3/2005 | Layne et al. | ..... | 362/404 |
| 6,929,382 | B2 * | 8/2005 | Kuisma | ..... | 362/219 |
| 6,984,055 | B2 * | 1/2006 | McCarthy et al. | ..... | 362/219 |
| 7,090,375 | B2 * | 8/2006 | Kuisma | ..... | 362/225 |
| 7,465,063 | B2 * | 12/2008 | Stillman | ..... | 362/225 |
| 2006/0012977 | A1 * | 1/2006 | Joseph | ..... | 362/147 |
| 2008/0273330 | A1 | 11/2008 | Tyson et al. | ..... | 362/294 |

* cited by examiner

*Primary Examiner* — Hargobind S Sawhney
(74) *Attorney, Agent, or Firm* — Connolly Bove Lodge & Hutz LLP

(57) ABSTRACT

An LED light fixture includes a housing, a lens and a flexible gasket there between. Each of the housing and the lens has an elongate main body and two ends sealingly fixed to the main body. The assembly of components in the housing defines a sealing channel rectangular in plan and the lens similarly defines a sealing ridge. A mounting plate with light emitting diodes distributed on the mounting plate further includes a manifold plate positioned on the mounting plate which includes holes therethrough with reflectors about the holes to receive the light emitting diodes. Mounts supporting the elongate housing define longitudinally adjustable engagements with the housing. The mounts further include tracks arranged in arcs of circles located in planes perpendicular to the extension of the elongate housing. Munting brackets engage these tracks using retainers.

13 Claims, 10 Drawing Sheets

Fig. 11
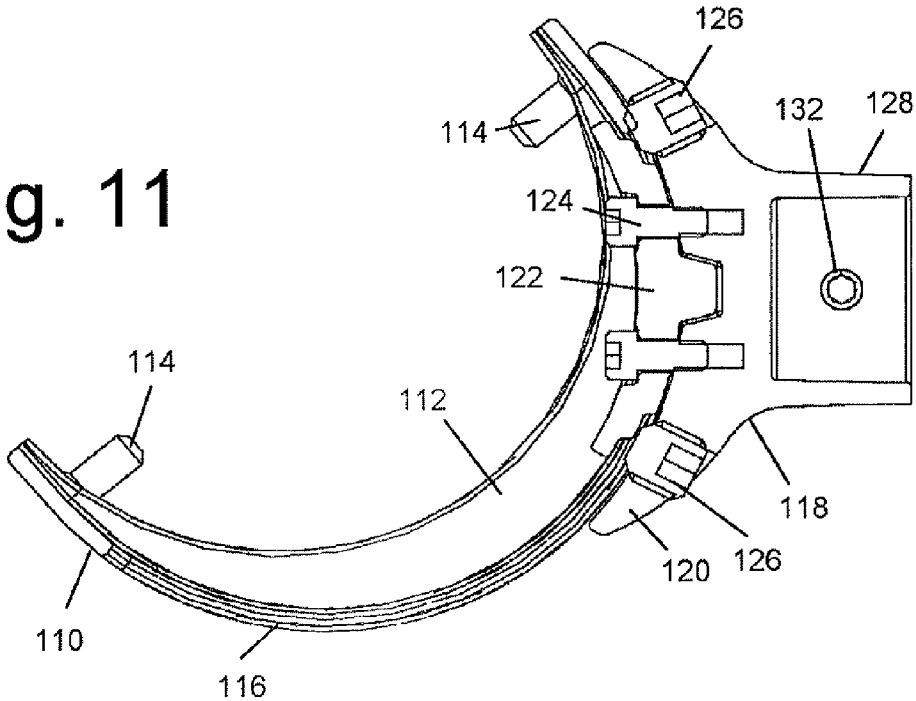
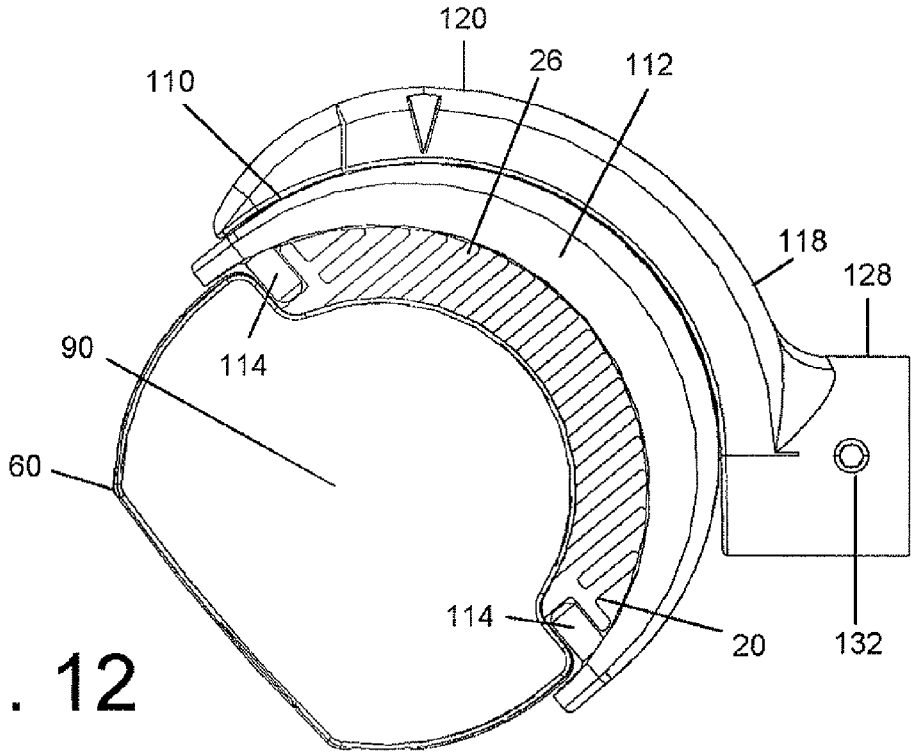
Fig. 12

ARCHITECTURAL LIGHTING

BACKGROUND OF THE INVENTION

The field of the present invention is LED light fixtures for architectural lighting.

Architectural lighting is typically employed to add dramatic effect to the architecture of a building or other structure. The nature, configuration and placement of the fixtures providing such lighting are responsive to the configuration and structure of the building. Consequently, versatile light fixtures are needed to accommodate wide ranging demands for architectural lighting. Light intensity, light distribution, source position, adjustability and fixture appearance all can be factors in architectural lighting designs. Such requirements often require flexibility that is difficult to satisfy with a common fixture design. Additional demands placed on architectural lighting and the use thereof include moisture resistance, maintenance needs and adjustability. All such factors can add to difficulties in design and fabrication of architectural lighting fixtures.

SUMMARY OF THE INVENTION

The present invention is directed to architectural lighting using LED lamps in an elongate housing with a lamp mounting surface enclosed by a lens.

In a first separate aspect of the present invention, the elongate housing is adjustably supported on mounts which are in turn received by mounting brackets. The elongate housing and the mounts define elongate engagements allowing longitudinal adjustment of the mounts along the housing. Such adjustments allow conformation with the architectural structure. The mounts further include tracks arranged in arcs of circles located in planes perpendicular to the extension of the elongate housing. The mounting brackets engage these tracks using retainers, allowing aiming of the LED light fixture. With these attributes, a fixture is able to readily adjust to many architectural needs and conditions.

In a second separate aspect of the present invention, the elongate housing is adjustably supported on mounts which are in turn received by mounting brackets. The mounts include tracks arranged in arcs of circles located in planes perpendicular to the extension of the elongate housing. The mounting brackets engage these tracks using retainers, allowing aiming of the LED light fixture. The fixture is able to be adjusted such that the lens is allowed to face in a range of 360° as measured about an axis extending in the elongate direction of the housing.

In a third separate aspect of the present invention, an LED light fixture includes a housing, a lens fixable on the housing and a flexible gasket. The housing has an elongate main body and two ends sealingly fixed to the main body. The main body has two parallel elongate channels extending the length thereof and each end has two channels which are aligned with the elongate channels and a cross channel between the end channels so as to form a seal channel rectangular in plan. The lens includes a seal ridge tapered to mate fully about the seal channel with the lens fixed in the housing. The gasket is positioned therebetween. This arrangement with the component housing allows for uniformity of product with different housing lengths. Again, architectural needs are readily accommodated.

In a fourth separate aspect of the present invention, the device of the third separate aspect further includes a mounting plate with light emitting diodes distributed on the mounting plate. A manifold plate is positioned on the mounting plate and includes holes therethrough with reflectors about the holes to receive the light emitting diodes. This facilitates uniform placement and fabrication, often with variations based solely on length.

In a fifth separate aspect of the present invention, an elongate housing has a lamp mounting surface with a seal channel rectangular in plan about the lamp mounting surface. A lens is fixable on the elongate housing and includes an elongate lens body and two lens ends sealingly affixed to the lens body. The elongate lens body has two parallel elongate ridges which are aligned with end ridges on the lens ends. The lens ends each have a cross ridge extending between the parallel end ridges; all thereby defining a rectangular seal ridge. The seal ridge has inwardly inclined sides with the base of the seal ridge being wider than the seal channel. The seal ridge mates with the seal channel with the lens fixed to the elongate housing.

In a sixth separate aspect of the present invention, any of the foregoing aspects are contemplated to be combined to further advantage.

Accordingly, it is an object of the present invention to provide an improved LED light fixture for architectural lighting. Other and further objects and advantages will appear hereinafter.

BRIEF DESCRIPTION OF THE DRAWINGS

FIG. 11 is a cross-sectional side view of the mounting of FIG. 8.

FIG. 12 is an end view of a second embodiment of the light fixture and mounting.

DETAILED DESCRIPTION OF THE PREFERRED EMBODIMENTS

Figure 1:
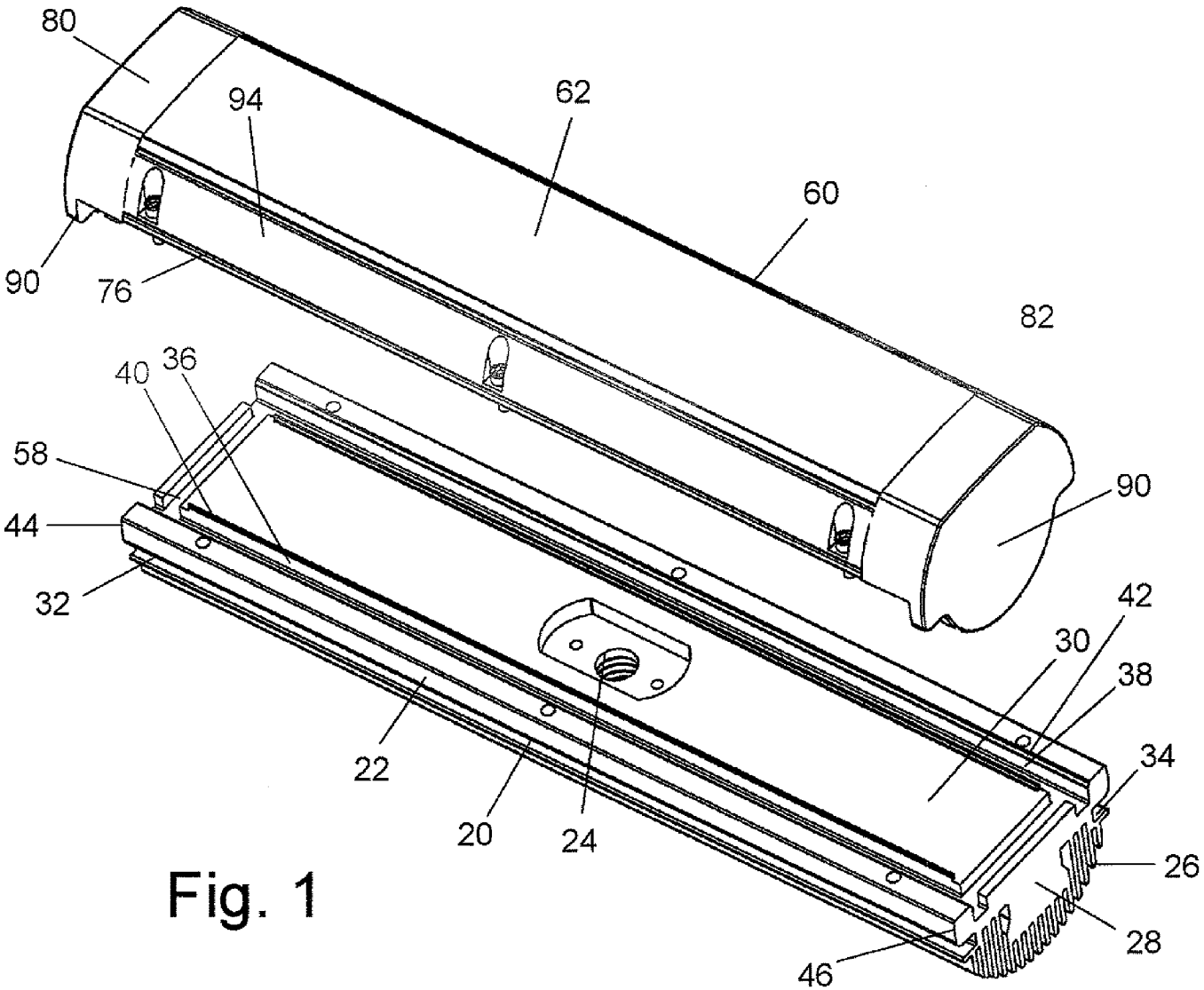
FIG. 1 is a perspective exploded assembly view of a fixture housing and lens.
Figure 2:
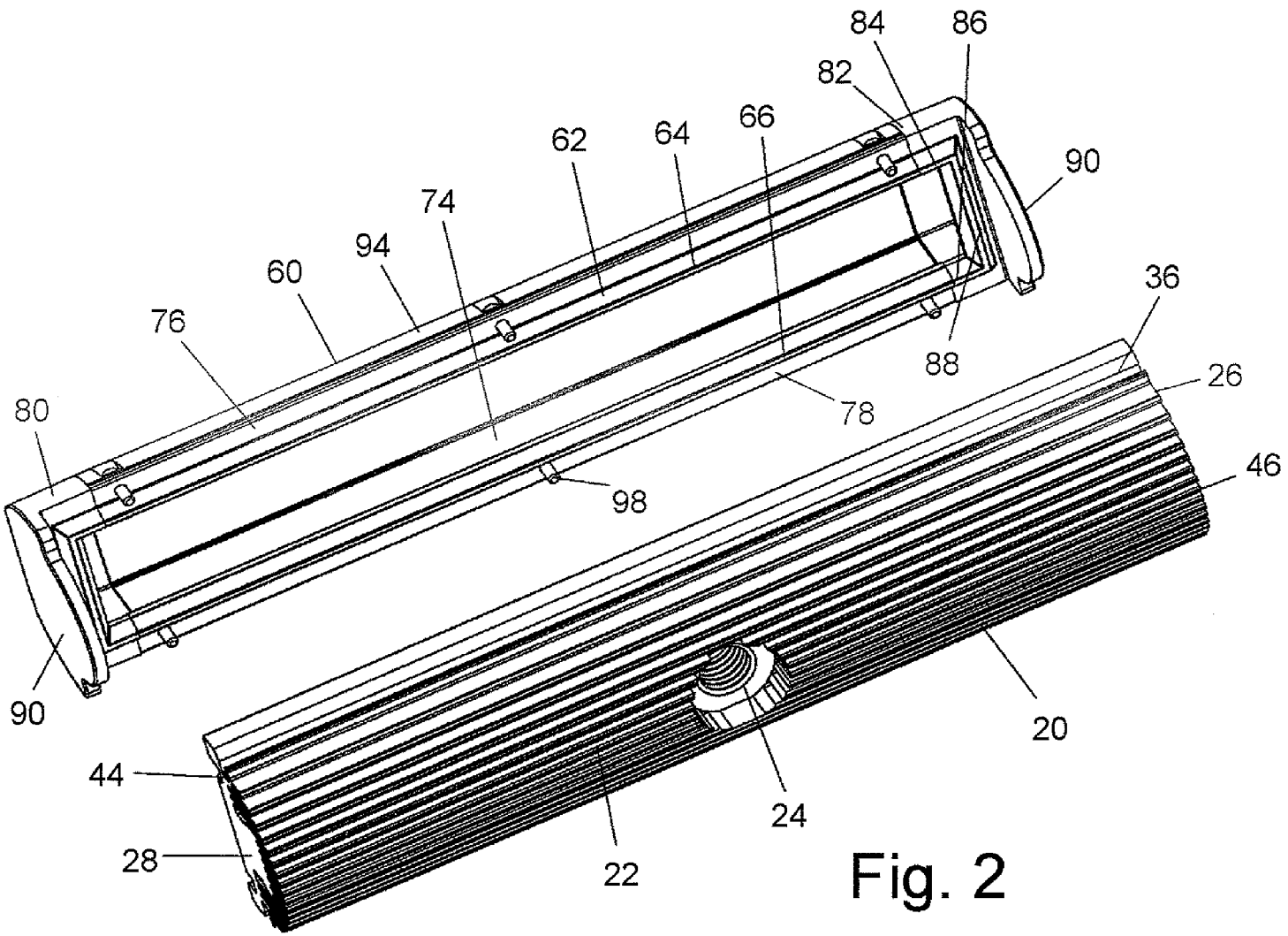
FIG. 2 is a perspective exploded assembly view of the fixture housing and lens of FIG. 1.
Figure 3:
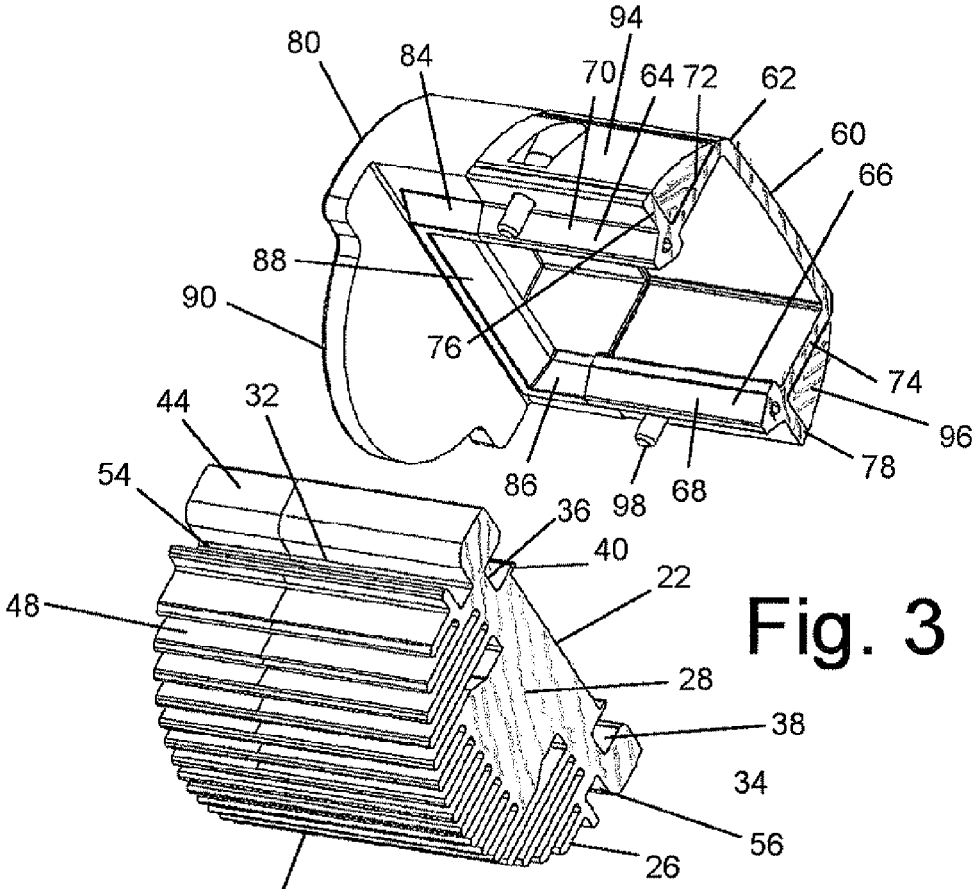
FIG. 3 is a perspective exploded assembly and sectioned view of the fixture housing and lens of FIG. 1.
Figure 4:
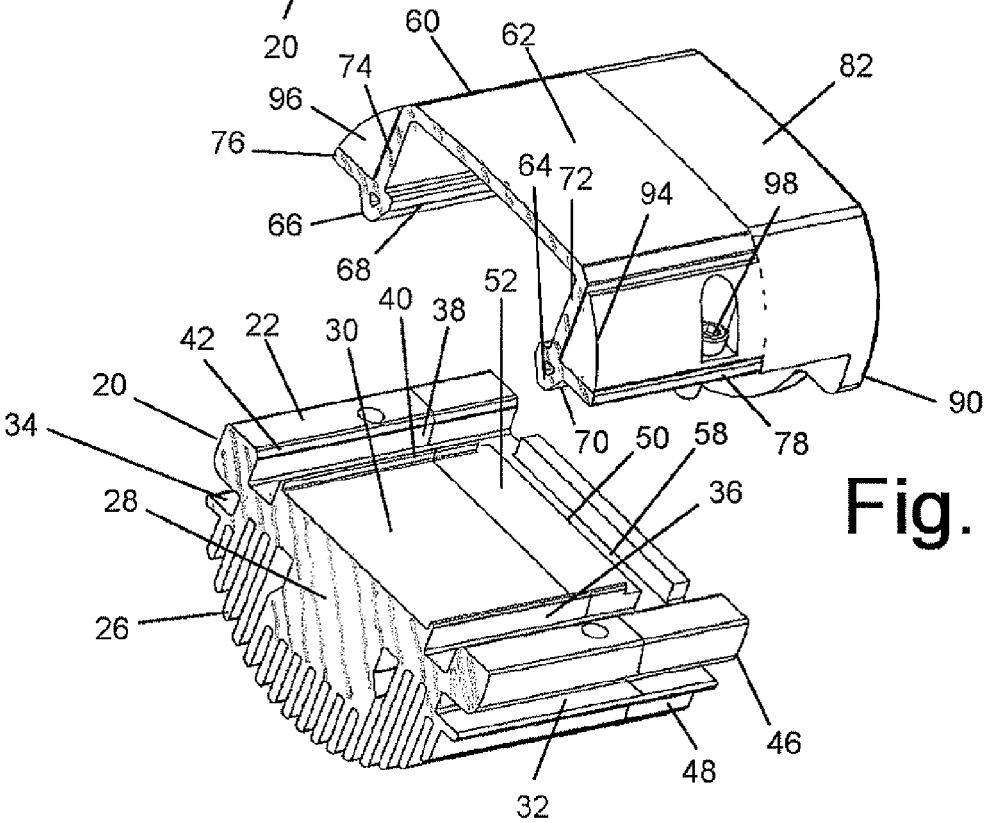
FIG. 4 is a perspective exploded assembly and sectioned view of the fixture housing and lens of FIG. 1.
Figure 5:
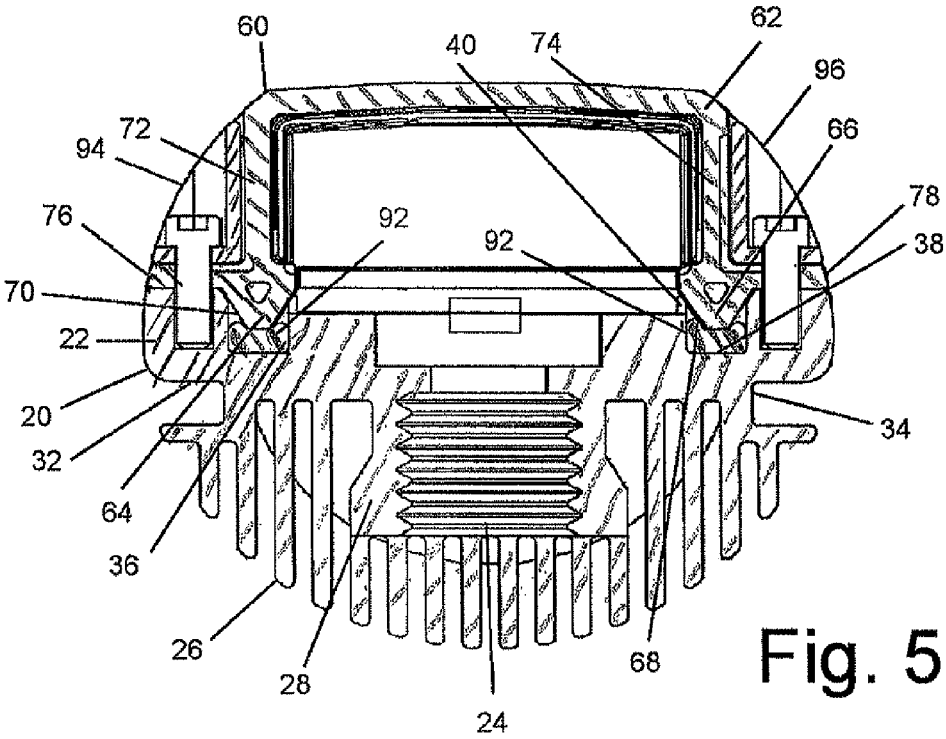
FIG. 5 is a cross-sectional end view of the assembled fixture housing and lens of FIG. 1.
Figure 8:
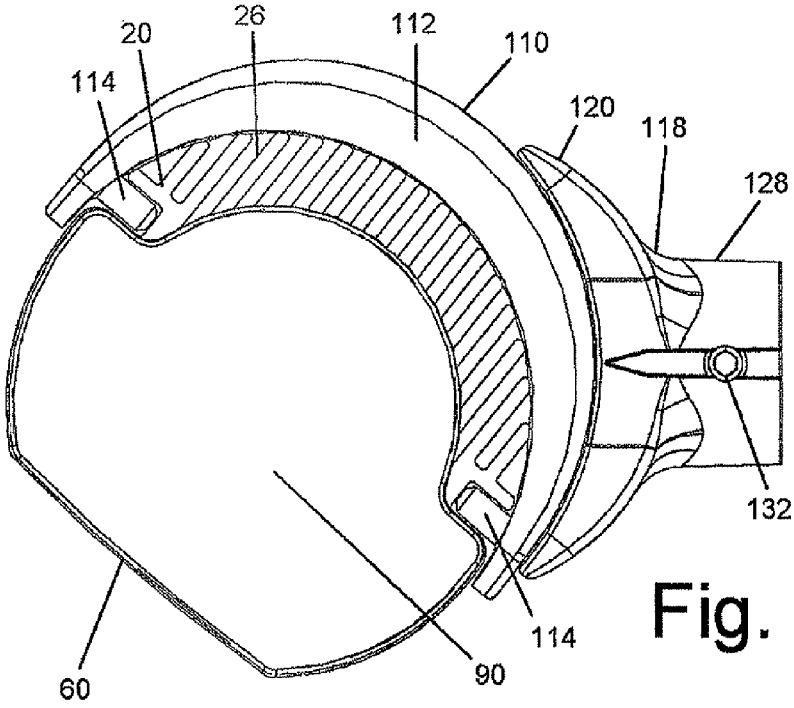
FIG. 8 is an end view of a first embodiment of the light fixture and mounting.
Figure 6:
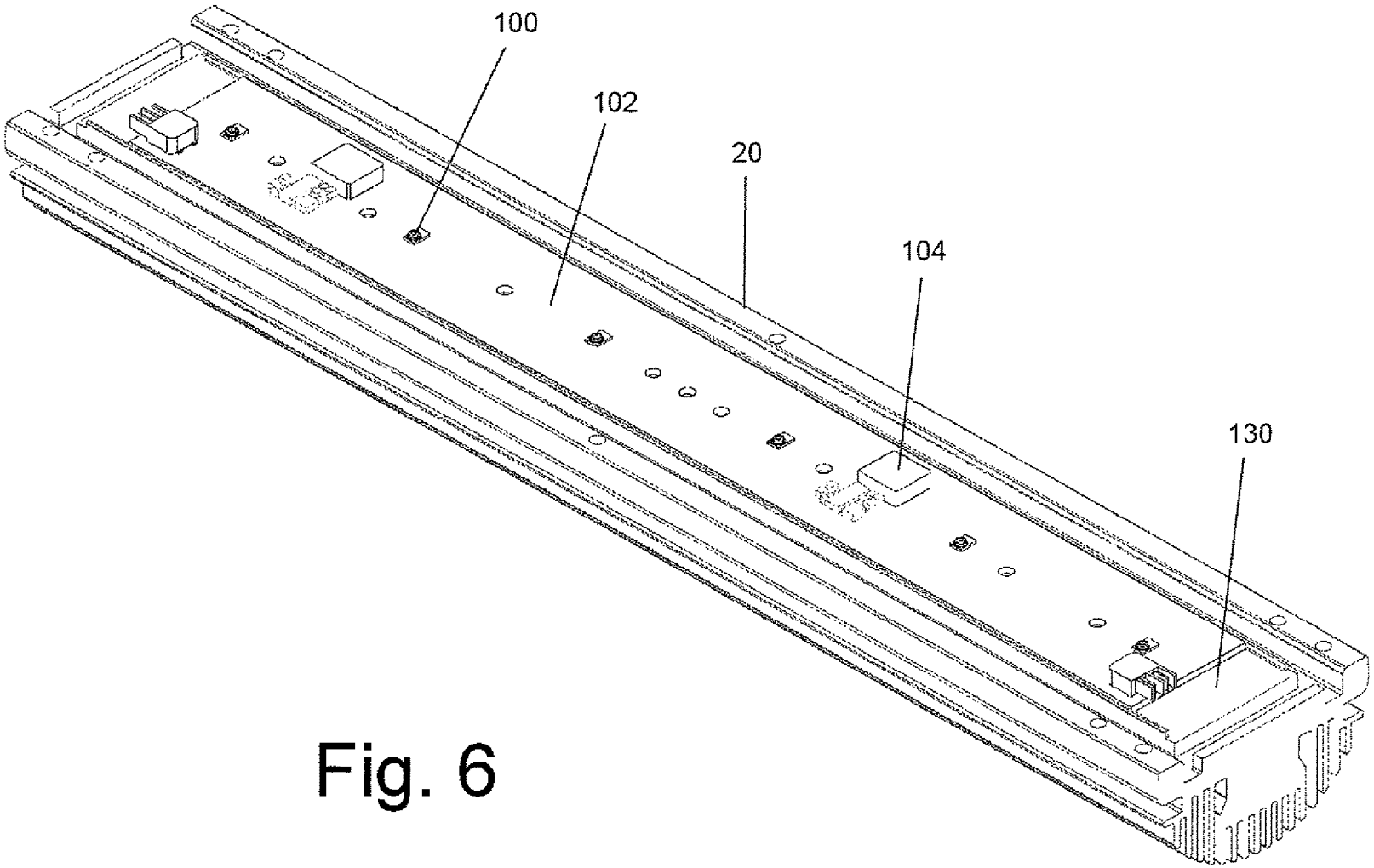
FIG. 6 is a perspective view of the housing of FIG. 1 and a mounting plate with light-emitting diodes thereon.
Figure 7:
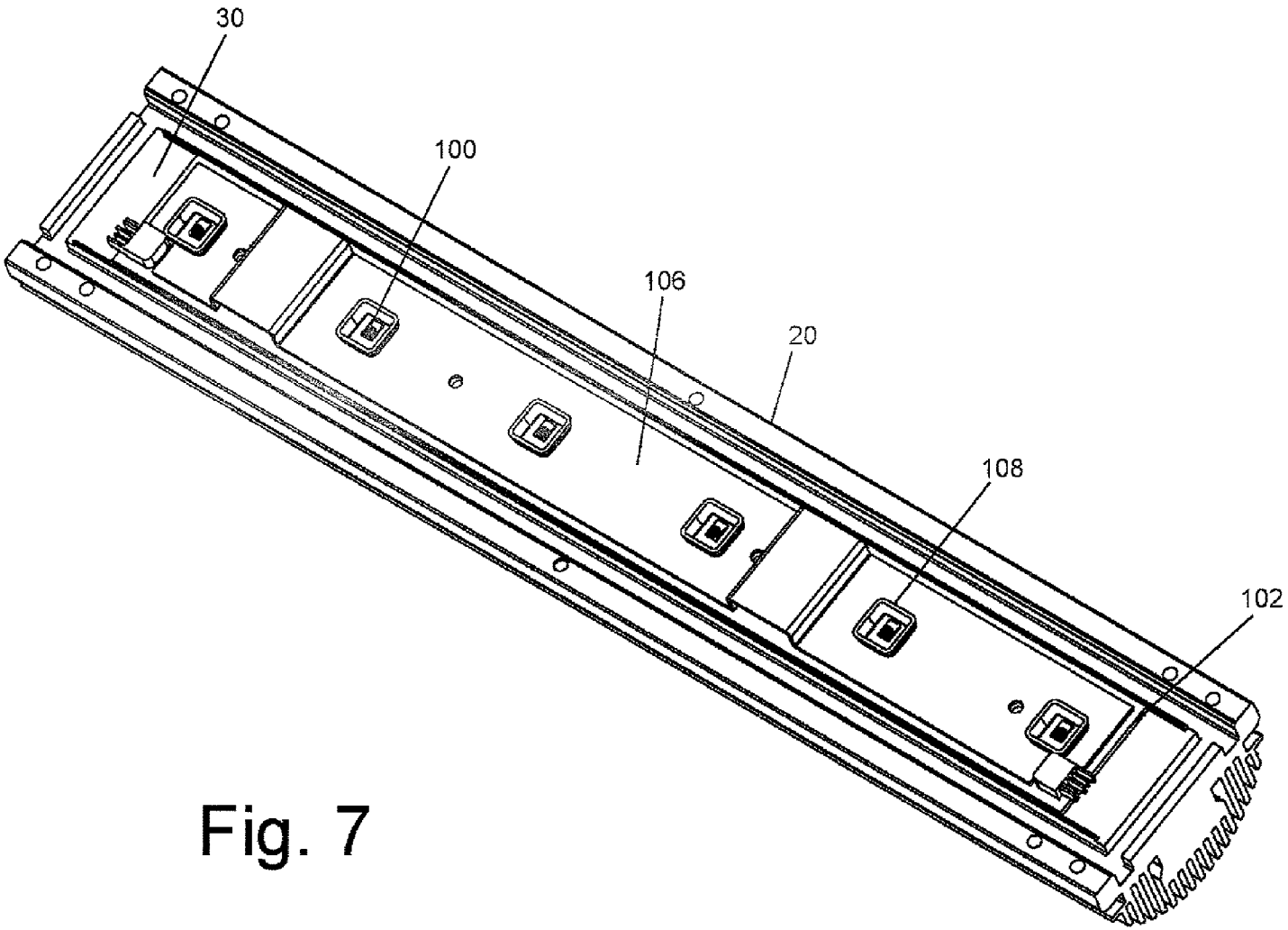
FIG. 7 is a perspective view of the housing of FIG. 1 and a manifold plate with reflectors thereon.
Figure 9:
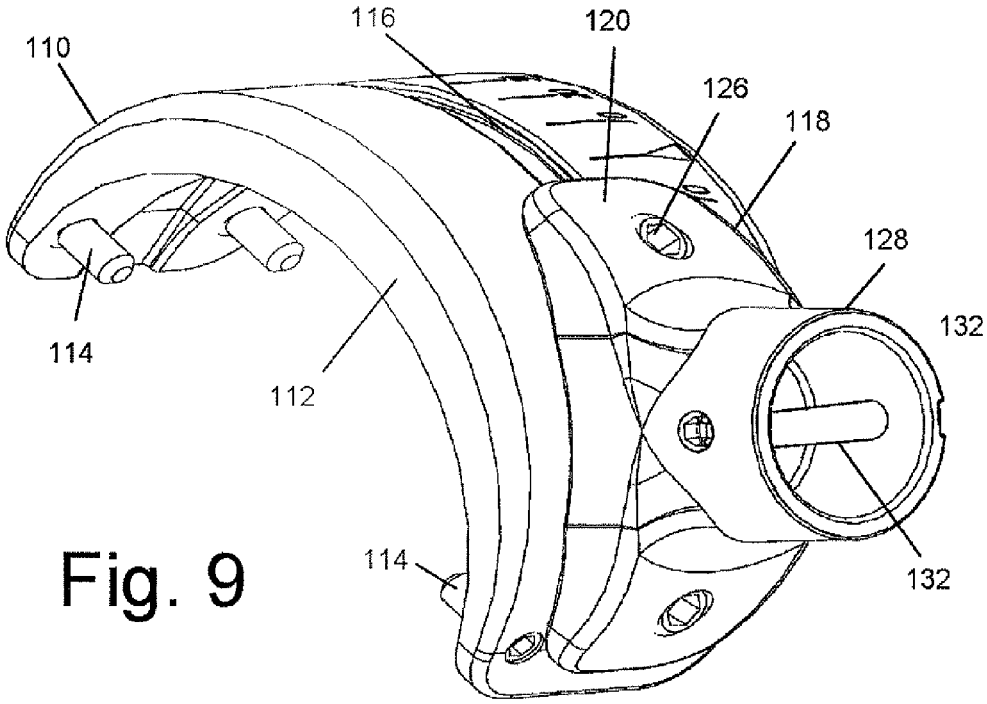
FIG. 9 is a perspective view of the mounting of FIG. 8.
Figure 10:
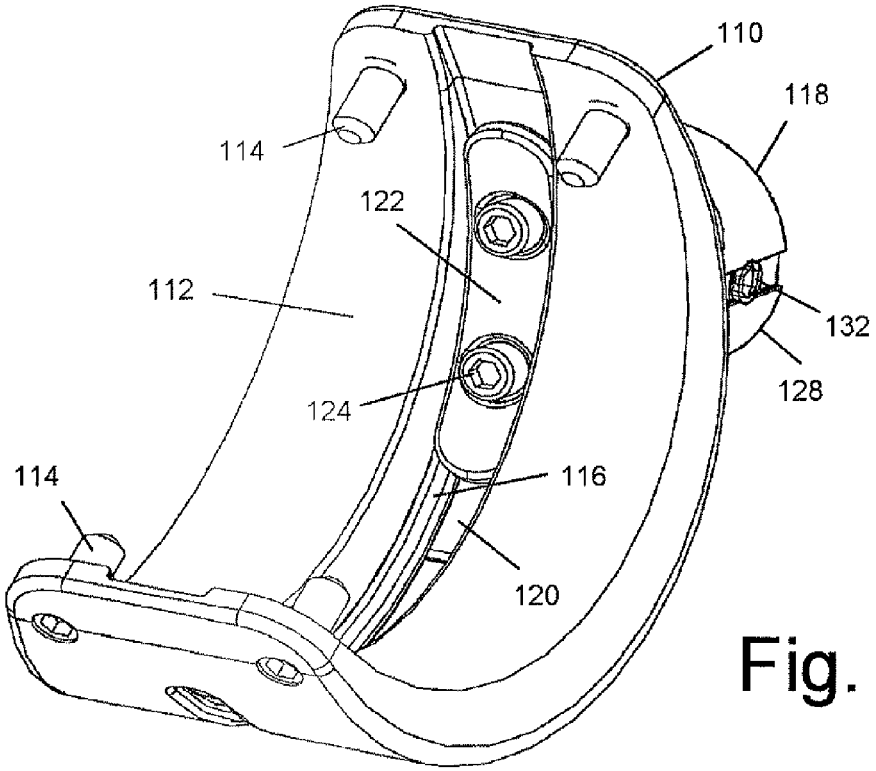
FIG. 10 is a perspective view of the mounting of FIG. 8.

Turning in detail to the drawings, an LED light fixture has an elongate housing 20 with an extruded elongate main body 22. An access port 24 extends through the body 22 for electrical connections. The body 22 is thermally conductive with a substantial array of cooling fins 26 extending from an integral block 28 forming the base of the body 22. A mounting surface 30 to receive lighting elements is to one side of the base 28 opposite to the fins 26. Two opposed, outwardly facing channels 32, 34 extend the length of the elongate main body 22.

Two parallel elongate channels 36, 38 extend the length of the elongate main body 22 to either side of the mounting surface 30. These channels 36, 38 include outwardly beveled portions 40, 42 at the opening of each of the channels 36, 38. The beveled portions 40, associated with each of the channels 36, 38 inwardly on the main body 22 are formed by upstanding ridges defining the lateral extent of the mounting surface 30.

The elongate housing 20 further includes two ends 44, 46. These ends 44, 46 are formed of the same extruded stock as the main body 22 and each is sealingly attached to the main body 22 at the ends thereof. Alternatively, the elongate housing 20 may be of a single extruded piece. Thus, the two ends 44, 46 also include cooling fins 48, an integral base 50, a mounting surface 52 and opposed, outwardly facing channels 54, 56. Additionally, a cross channel 58 is cut into each of the ends 44, 46 to extend between the two parallel end channels 54, 56. When the ends 44, 46 are sealingly fixed to the main body 22, the several channels combine to form a seal channel which is rectangular in plan.

The fixture further includes a lens 60 which is fixable to the elongate housing 20 to close the mounting surface area of the elongate housing 20. The lens 60 includes an extruded elongate main body 62. This elongate main body 62 includes parallel ridges 64, 66 along the entire length thereof. These ridges 64, 66 each include inwardly inclined sides 68, 70 extending upwardly from a base. The base has a width broader than the elongate channels 36, 38. The lens 60 may take on various elongate optical features as applicable to specific job requirements. The sidewalls 72, 74 of the elongate main body 62 preferably lie in parallel planes with terminal flanges 76, 78 extending outwardly from the sidewalls 72, 74.

The lens 60 also includes two lens ends 80, 82 which are sealingly fixed to the elongate main body 62. The lens ends 80, 82 are molded to match the ends of the main body 62 at the interfaced, including with the ridges 64, 66. Ridges 84, 86 are aligned therewith and terminate in a cross ridge 88 to define a rectangular sealing ridge to mate fully about the seal channel when the lens 60 is fixed to the housing. Each lens end 80, 82 includes an end plate 90 to provide a finish to the fixture, covering the ends of the block base 28. With the lens 60 assembled with the lens ends 80, 82 sealingly fixed to the elongate main body 62, the lens 60 may be assembled with the elongate housing 20. A gasket 92 is positioned in the seal channel before attaching the lens 60. Retainers 94, 96 are positioned along the sidewalls 72, 74. These retainers 94, 96 have a rounded outer surface to smooth off the lens exterior. Threaded fasteners are then extended through the retainers 94, 96 and the terminal flanges 76, 78 to tighten into threaded holes on the elongate housing 20. Tightening the fasteners 98 then brings the seal ridge forcefully into the seal channel to compress the gasket 92 for sealing of the fixture. The retainers 94, 96 may also be configured to spread the load across the terminal flanges 76, 78 for less distortion and better sealing along the entire elongate portions of the fixture.

Light emitting diodes 100 are conventionally retained on a mounting plate 102. The diodes 100 may be arranged as optically desirable and typically would be spaced from one another to reduce the heat load on the housing 20. The mounting plate 102 further mounts the electronics 104 driving the diodes 100. The mounting plate 102 may be separately fabricated and assembled with the electronics and supporting conductors prior to assembly with the fixture. The mounting plate 102 may then be appropriately positioned and retained on the mounting surface 30 between the outwardly beveled portions 40. Advantageously, the mounting plate 102 is affixed to the mounting surface 30 such that substantial heat transfer can occur between components. A passageway may be longitudinally 0cut into the mounting plate 102 or formed in the mounting surface 30 to accommodate wiring to the electronics 104 and diodes 100. A manifold plate 106 is positioned above the diodes 100 and electronics 104 on the mounting plate 102. This manifold plate has holes through which the diodes 100 extend. These holes include reflectors 108 to advantageously redirect light emitted by the diodes 100 toward and through the lens 60. The manifold plate 106 and reflectors 108 may also be separately fabricated and affixed to the mounting plate 102 in association with the diodes 100 and electronics 104 before assembly with the elongate housing 20 at the mounting surface 30.

The elongate housing 20 is associated with multiple mounts 110. These mounts 110 each include a clevis 112 which extends about the housing 20 to the opposed, outwardly-facing channels 32, 34. Pins 114 extend into the channels 32, 34 such that the housing 20 and the mounts 110 move relative to one another for longitudinal adjustment of the mounts along the elongate housing. The clevis 112 is shown to be arcuate about its inner bite to come close to but not interfere with the housing 20. The clevis 112 of each mount 110 includes a track 116. The track 116 extends in an arc of a circle lying within a plane perpendicular to the extension of the elongate housing 20 when the mount 110 is engaged with that housing. The track 116 is arranged to either side of a central passageway and is concentric with the outer side of the clevis 112 which is preferably circular.

The mounts 110 are in turn retained by mounting brackets 118. The mounting brackets 118 include a cradle 120. The cradle 120 receives the outside of the clevis 112. The cradle 120 engages a retainer 122 through the opening in the track 116 of the associated mount 110. The retainer 122 is too large to fit through the opening in the track 116 and its retention by the cradle 120 thereby engages the mount 110. The retainer 122 also has a larger dimension in the direction of the track 116 to maintain the mount 110 aligned in the cradle 120.

The retainer 122 held firmly in the cradle 120 by the fasteners 124 is loose within the track 116 so that the mount 110 may move about the arc of the track relative to the cradle 120. Locking elements 126 threaded through the cradle 120 toward the retainer 122 can selectively fix the mount 110 relative to the cradle 120. The locking elements 126 are set screws which engage the outside of the mount 110 when advanced through the cradle 120 to draw the retainer 122 into binding engagement with the track 116.

Figure 13:
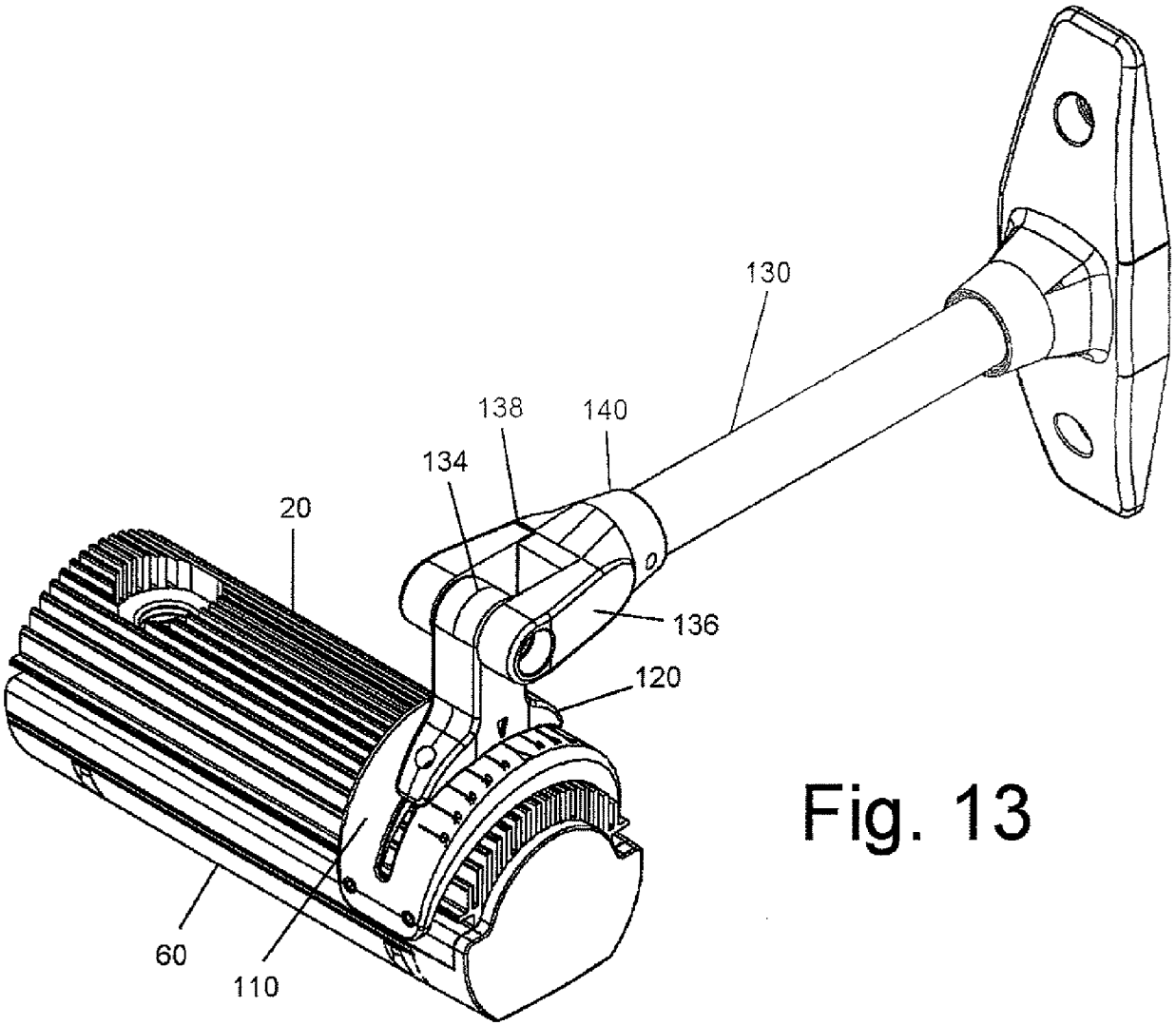
FIG. 13 is a perspective view of a third embodiment of the light fixture and mounting.
Figure 14:
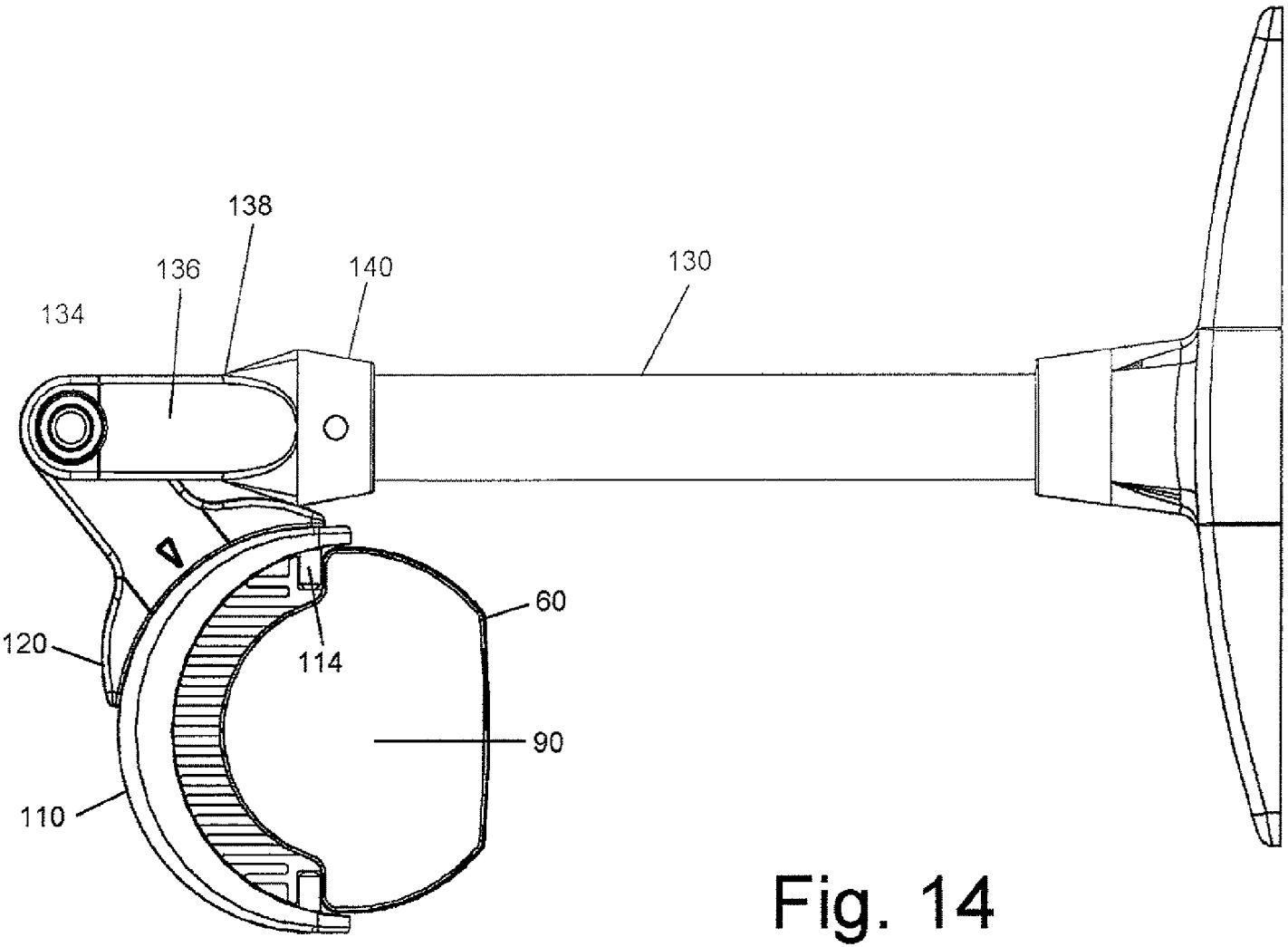
FIG. 14 is a side view of the third embodiment of the light fixture and mounting.

The mounting brackets 118 further include an engagement socket or other pivot mount for attachment to the architectural structure. In the embodiment of FIGS. 8-12, a socket 128 receives an anchor post 130, retained by a bolt 132 extending through the socket 128. The device of FIG. 12 differs from the device of FIGS. 8-11 in that the socket 128 is displaced 90° relative to the retainer 122 from that of the embodiment of FIGS. 8-11. In FIGS. 13-14, a pivot mount 134 forms a part of the mounting bracket 118.

Looking specifically to the embodiment of FIGS. 13-14, the pivot mount 134 is received by a clevis mount 136. The clevis mount 136 is part of a link 138 which includes a socket 140 at the opposite end for similar attachment as the first embodiment. The socket 140 is shown to be attached to an anchor post 130 in FIG. 12. The link 138 combining the clevis mount 136 and socket 140 pivots about an axis parallel to the elongate direction of the housing 20 when all is assembled to allow adjustment of the direction of the illumination. The sum of movement of the retainer 122 in the track 116 and the pivot between the pivot mount 134 and the link 138 allows the lens 60 to face in a full range of 360° relative to the supporting anchor post 130, see FIG. 14. Thus, a light mounted to a wall may in fact illuminate directly that wall, either above or below the mounting post or may alternatively direct illumination outwardly anywhere between those two positions.

Thus, a versatile and easily manufactured LED architectural lighting fixture is disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. An LED light fixture comprising an elongate housing including a lamp mounting surface;

a lens fixable on the housing to close over the lamp mounting surface;

mounts, each mount including a clevis and a track extending in an arc of a circle in a plane perpendicular to the extension of the elongate housing, the elongate housing and the devises defining elongate engagements, respectively, with longitudinal adjustment of the mounts along the elongate housing;

mounting brackets engaging the mounts, respectively, the mounting brackets including retainers engaged with the tracks to move about the arcs of the tracks and locking elements to selectively fix the retainers on the tracks.

2. The LED light fixture of claim 1, the elongate engagements including opposed, outwardly facing channels extending longitudinally of the elongate housing and pins on the mounts extending inwardly into the opposed channels.

3. The LED light fixture of claim 1, each mounting bracket further including an anchor post and a link pivoted to the anchor post about an axis parallel to the extension of the channels, the link having the retainer and locking element thereon, the sum of movement of the retainer in the track and the pivoted link allowing the lens to face in a range of 360° relative to the anchor post.

4. The LED light fixture of claim 1, the locking elements being set screws engaged with the mounting brackets and extending to selectively engage the tracks to draw the retainers into binding engagement with the tracks.

5. An LED light fixture comprising a housing with a lamp mounting surface, the housing including an elongate main body and two ends of identical extruded cross section coaxially sealed together, the main body having two parallel elongate channels extending the length of the elongate main body, each end having two parallel end channels aligned with the parallel elongate channels of the elongate main body when the end is fixed to the main body and a cross channel extending between the two parallel end channels of the end, the parallel elongate channels of the main body, the parallel end channels of the ends and the cross channels defining a seal channel rectangular in plan about the lamp mounting surface;

a lens fixable on the housing to close over the lamp mounting surface, the lens including a seal ridge rectangular in plan having inwardly inclined sides extending from the lens, the seal ridge mating with the seal channel with the lens fixed to the housing, the base of the seal ridge being wider than the seal channel;

a flexible gasket in and fully about the seal channel.

6. The LED light fixture of claim 5, the parallel elongate channels having outwardly beveled portions at the opening of the seal channel.

7. The LED light fixture of claim 5, the lens further including an elongate lens body and two lens ends sealingly affixed to the lens body, the elongate lens body having two parallel elongate ridges, each lens end having two parallel end ridges aligned with the parallel elongate ridges of the elongate lens body when the end is fixed to the elongate lens body and a cross ridge extending between the two parallel end ridges of the end, the parallel elongate ridges of the lens body, the parallel end ridges of the lens ends and the cross ridges defining the seal ridge.

8. An LED light fixture comprising an elongate housing with a lamp mounting surface, the elongate housing including a seal channel rectangular in plan about the lamp mounting surface;

a lens fixable on the elongate housing to close over the lamp mounting surface, the lens including an elongate lens body and two lens ends sealingly affixed to the lens body, the elongate lens body having two parallel elongate ridges, each lens end having two parallel end ridges aligned with the parallel elongate ridges of the elongate lens body when the end is fixed to the elongate lens body and a cross ridge extending between the two parallel end ridges of the end, the parallel elongate ridges of the lens body, the parallel end ridges of the lens ends and the cross ridges defining a seal ridge rectangular in plan having inwardly inclined sides extending from the lens, the seal ridge mating with the seal channel with the lens fixed to the elongate housing, the base of the seal ridge being wider than the seal channel;

a flexible gasket in and fully along the seal channel.

9. The LED light fixture of claim 8, the elongate housing being formed from one extrusion or more than one extrusion of identical cross section and coaxially sealed together, the one or more extrusions including a block base and cooling fins, the lamp mounting surface being one side of the block base and the cooling fins extending from the opposed side of the block base, the lens ends each including a terminal flange extending to cover the ends of the block base.

10. The LED light fixture of claim 9 further comprising mounts, each mount including a clevis, the elongate housing and the devises defining elongate engagements, respectively, with longitudinal adjustment of the mounts along the elongate housing.

11. The LED light fixture of claim 10, the elongate engagements including opposed, outwardly facing channels extending longitudinally of the elongate housing and pins on the mounts extending inwardly into the opposed channels.

12. The LED light fixture of claim 10 further comprising mounting brackets engaging the mounts, the mounts each further including a track extending in an arc of a circle in a plane perpendicular to the extension of the elongate housing, the mounting brackets including retainers engaged with the tracks to move about the arcs of the tracks and locking elements to selectively fix the retainers on the tracks.

13. The LED light fixture of claim 8 further comprising a mounting plate on the mounting surface;

light-emitting diodes distributed on the mounting plate and facing the lens;

a manifold plate on the mounting plate and including holes therethrough with reflectors thereabout, respectively, the light-emitting diodes extending through the holes.

* * * * *

UNITED STATES PATENT AND TRADEMARK OFFICE

CERTIFICATE OF CORRECTION

PATENT NO. : 8,142,047 B2
APPLICATION NO. : 12/637377
DATED : March 27, 2012
INVENTOR(S) : Ken J. Acampora et al.

It is certified that error appears in the above-identified patent and that said Letters Patent is hereby corrected as shown below:

In Claim 1 (col. 5, l. 21), delete "devises" and insert -- clevises -- therefor.

In Claim 10 (col. 6, l. 42), delete "devises" and insert -- clevises -- therefor.

Signed and Sealed this
Twenty-sixth Day of June, 2012

David J. Kappos

David J. Kappos
*Director of the United States Patent and Trademark Office*